US006679734B2

(12) United States Patent
Lomastro et al.

(10) Patent No.: US 6,679,734 B2
(45) Date of Patent: Jan. 20, 2004

(54) SUBMINIATURE ELECTRICAL CONNECTOR MULTI-PIN GROUNDING/ DISCRETE CIRCUIT BUSSING MODULE AND INTEGRAL CONNECTOR BACKSHELL

(75) Inventors: Joseph A. Lomastro, Springhill, FL (US); Santiago Llano, Miami, FL (US); David Gracey, Seattle, WA (US)

(73) Assignee: Array Connector Corporation, Miami, FL (US)

( * ) Notice: Subject to any disclaimer, the term of this patent is extended or adjusted under 35 U.S.C. 154(b) by 56 days.

(21) Appl. No.: 10/062,434

(22) Filed: Feb. 5, 2002

(65) Prior Publication Data

US 2002/0127896 A1 Sep. 12, 2002

Related U.S. Application Data

(60) Continuation-in-part of application No. 09/929,336, filed on Aug. 15, 2001, which is a division of application No. 09/404,738, filed on Sep. 24, 1999, now Pat. No. 6,290,550.

(60) Provisional application No. 60/265,906, filed on Feb. 5, 2001.

(51) Int. Cl.[7] ..... H01R 11/09

(52) U.S. Cl. ..... 439/723; 439/724; 439/885

(58) Field of Search ..... 439/723, 724, 439/885

(56) References Cited

U.S. PATENT DOCUMENTS

| | | | | |
|---|---|---|---|---|
| 3,652,977 A | * | 3/1972 | Feldberg | 439/724 |
| 4,568,138 A | * | 2/1986 | McKenzie | 439/723 |
| 4,653,842 A | * | 3/1987 | Kirma | 439/723 |
| 5,192,233 A | * | 3/1993 | Suffredini et al. | 439/723 |

* cited by examiner

*Primary Examiner*—Tho D. Ta
(74) *Attorney, Agent, or Firm*—Arent Fox Kintner Plotkin & Kahn, PLLC

(57) ABSTRACT

A same potential block has a main body including a plurality of holes. A first metal piece, including a first carrier strip located adjacent to the main body and a plurality of clips extending from the first carrier. Each of the plurality of clips is positioned within a corresponding hole of the plurality of holes formed in the main body. A contact portion is positioned exterior and protruding from the main body and connected to the first metal piece to form a connector mating structure.

30 Claims, 11 Drawing Sheets

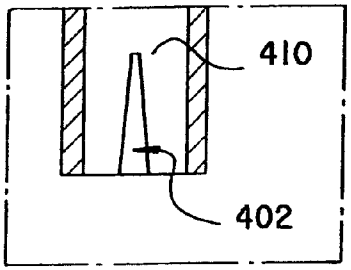
FIG.6D
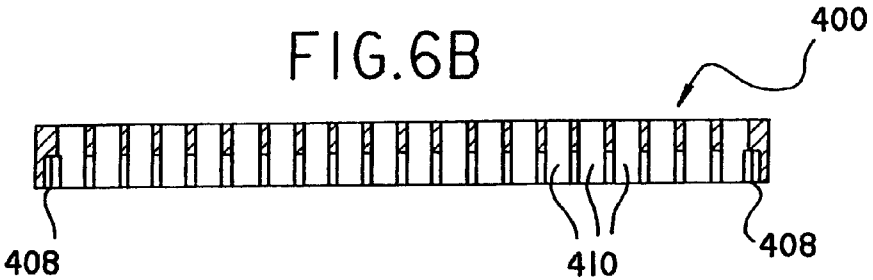
FIG.6B
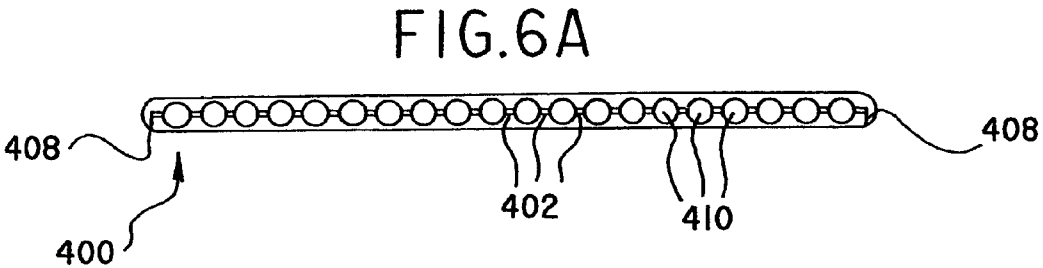
FIG.6A
FIG.6C
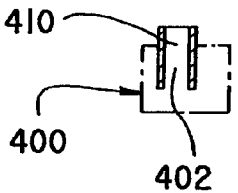

500
504
110
502
304a
304
304b
204a
204
204b 500
504
110
304a
304
304b
204a
204
204b
502

500
110
304a
304
304b
204a
504
204
204b
502

SUBMINIATURE ELECTRICAL CONNECTOR MULTI-PIN GROUNDING/ DISCRETE CIRCUIT BUSSING MODULE AND INTEGRAL CONNECTOR BACKSHELL

This application claims priority of provisional application 60/265,906 entitled "D-Subminiature Electrical Connector Multi-Pin Grounding/Discrete Circuit Bussing Module and Integral Connector Backshell" filed Feb. 5, 2001. This application is also a Continuation-in-Part of application Ser. No. 09/929,336, entitled "An Improved Same Potential Block Such as a Grounding Block and Method for Making an Improved Same Potential Block", filed Aug. 15, 2001, which is a Divisional of patent application Ser. No. 09/404,738, filed Sep. 24, 1999, now U.S. Pat. No. 6,290,550. These applications are hereby incorporated by reference in their entirety including all references cited therein.

BACKGROUND OF THE INVENTION

Computers and other signal processing devices utilize connectors to communicate signals to locations exterior to the computer. The signals are typically transmitted through a plurality of wires or cables which are connected to the computer through a connector. Shielded wires or shielded cables (hereinafter referred to collectively as "shielded wires") have a conductive shield braid surrounding signal wire(s) on which the signals are transmitted. The shield braid prevents electromagnetic interference (noise) from appearing on the signal wire, controlling interference between adjacent signal wires.

The shield braid of each shielded wire is grounded. Shielded wires have their signal wire connected directly into the connector, but may connect the shield braid to an exterior portion of the connector to ground the shield braid. Typically, the shielded wire has a length of insulation removed to expose the shield braid. A shield ground wire is attached at one end to the shield braid and attached at the other end directly to the connector (for example, connecting to a ring terminal which is attached to the connector through a screw) or connected indirectly to the connector through a grounding block (also called a ground block).

The grounding block includes multiple terminals, each of which is adapted to have a pin of the shield ground wire accommodated therein. Grounding blocks allow connections of the shielded cable to be made easily.

However, prior art grounding blocks have been relatively complicated to manufacture, thus increasing their cost to manufacture. The prior art grounding blocks may utilize relative expensive metal castings, machined metal components and polymers. As many as sixty-four different components were used to produce one prior art multi-pin grounding block.

SUMMARY OF THE INVENTION

The present invention is directed to a grounding block or other same-potential block having simple construction and a method for manufacturing such a grounding block or other same-potential block. In particular, the same potential block may include a main block having a plurality of holes. A first metal piece, including a carrier strip is located adjacent to the main body and a plurality of clips extend from the carrier strip, each of the plurality of carrier strips being positioned within a corresponding hole formed in the main body. A contact portion positioned exterior and protruding from the main body is provided, the contact portion being connected to the carrier strip to form a connector mating structure. The carrier strip maintains the same potential across each of the plurality of clips and a connector ground connected to the external contact portion.

BRIEF DESCRIPTION OF THE DRAWINGS

FIGS. 3A and 3B illustrate perspective views of opposite sides of the main body. FIG. 3C illustrates a cut-away view of a portion of the main body corresponding to cross-section IIIC—IIIC shown in FIG. 3B. FIG. 3D is a blown-up illustration of the end portion of the main body.

FIG. 4A illustrates a front view of the main clip. FIG. 4B illustrates a side view of the main clip.

FIG. 5A illustrates a front view of a slave clip. FIG. 5B illustrates a top view of the slave clip. FIG. 5C illustrates a side view of the slave clip.

FIGS. 6A, 6B and 6C illustrate one example of a cap. FIG. 6A illustrates a bottom view of the cap. FIG. 6B illustrates a cross-section along the length of the cap. FIG. 6C illustrates a cross-section along the width of the cap. FIG. 6D is a blown-up illustration of a portion of FIG. 6C.

DETAILED DESCRIPTION

At the outset, it is emphasized that the following detailed description merely sets forth examples of the invention. Advantages of the many aspects of the elements of these examples will be apparent to those skilled in the art. Not all aspects of the detailed example are intended to be a required part of the invention as the invention is broadly defined. It is emphasized that the spirit and scope of the invention is only intended to be defined by the claims.

The following description uses the term "grounding block" to describe the detailed example to simplify the description. However, it should be understood that the block is not required to be grounded; it is also contemplated that the block be used as a same-potential block where the block is used to deliver the same potential (other than a ground potential) to a pluraltiy of conductors.

Figure 1:
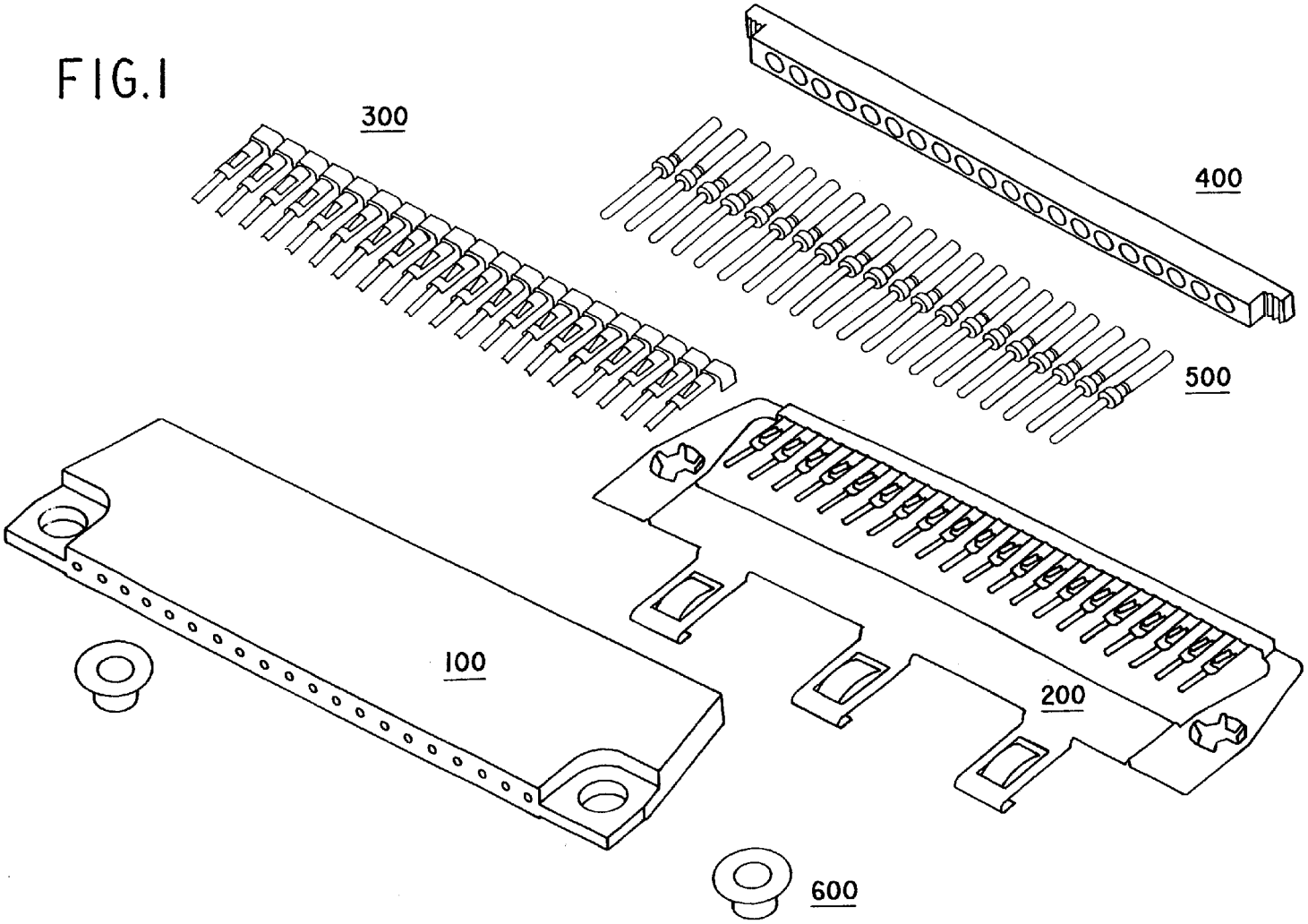
FIG. 1 illustrates an exploded view of the grounding block.

FIG. 1 illustrates an exploded view of the grounding block, including a main body 100, a main clip 200, a slave clip 300, a cap 400 and metallic rivets 600. Also illustrated are pins 500 which may be connected into the grounding block.

Figure 2:
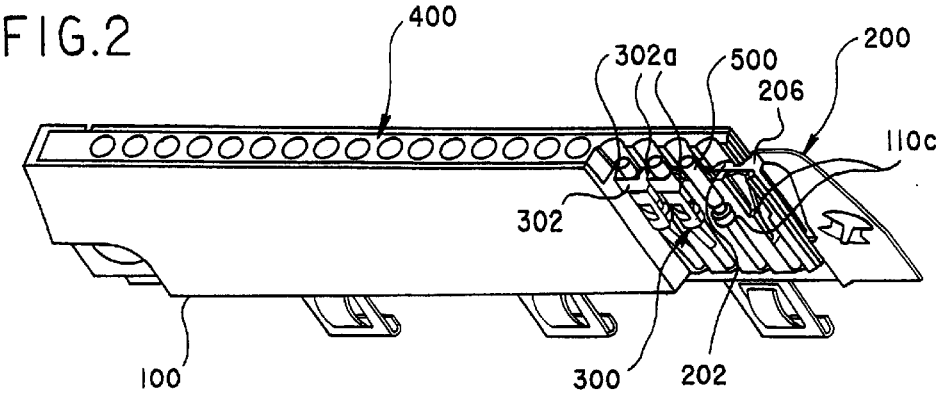
FIG. 2 illustrates the grounding block assembled with a cut away view of the main body and slave clip.

FIG. 2 illustrates the grounding block assembled with a cut-away view of the main body and slave clip to show how the elements are assembled. Further description of this assembly in FIG. 2 will be discussed below after the following detailed description of examples of the main body 100, main clip 200, slave clip 300 and cap 400.

Figure 3A:
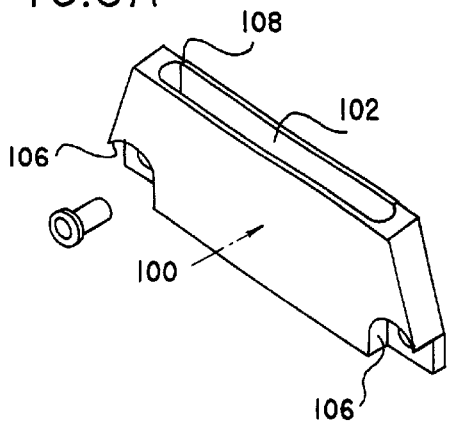
FIGS. 3A–3D illustrate one example of a main body.
Figure 3B:
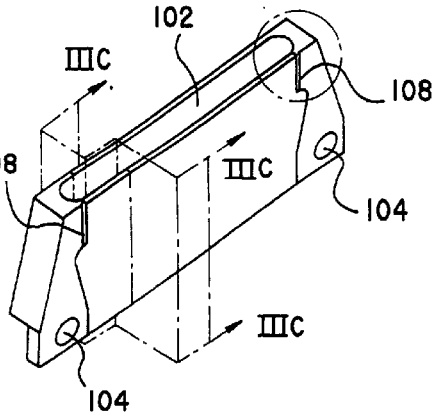

FIGS. 3A–3D illustrate one example of the main body 100. FIGS. 3A and 3B illustrate perspective views of opposite sides of main body 100. As illustrated, main body 100 is substantially rectangular in shape having a hollow 102 formed on an elongated side. Holes 104 are formed to extend through the major surfaces of main body 100 at opposite ends thereof. As shown best in FIG. 3A, indentations 106 may be formed in the main body at positions about holes 104.

Figure 3C:
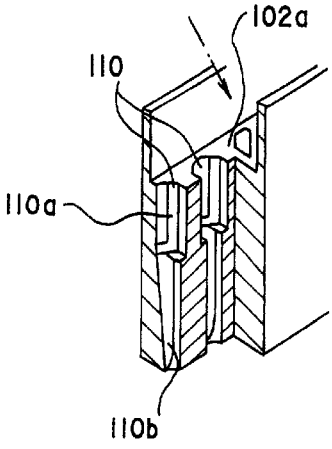
Figure 3D:
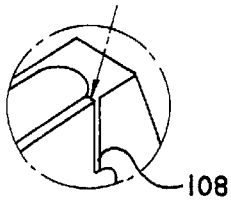

FIG. 3D is a blown-up illustration of the end portion of main body 100. One wall of hollow 102 includes a slot 108 which extends from a major surface of the main body into hollow 102. A second slot 108 is formed at the opposite end of hollow 102.

FIG. 3C illustrates a cut-away view of a portion of the main body corresponding to cross-section IIIC—IIIC shown in FIG. 3B. As illustrated in FIG. 3C, hollow portion 102 is defined on one side by a carrier strip resting surface 102*a*. Extending from carrier strip resting surface 102*a* through the main body are a plurality of holes 110. Each hole 110 includes a first large diameter or large width portion 110*a* and a second small diameter or small width portion 110*b*. For each hole 110, large diameter portion 110*a* extends from surface 102*a* and connects to small diameter portion 110*b*, which in turn extends through the main body 100. A ledge 110*c* is formed where the large diameter portion 110*a* meets the small diameter portion 110*b*. The shape of the large diameter portion 110*a* and the small diameter portion 110*b* are not necessarily cylindrical. The shapes preferably are designed for housing a certain pin and to allow insertion of a special jig to remove the pin, as in this example.

Figure 4B:
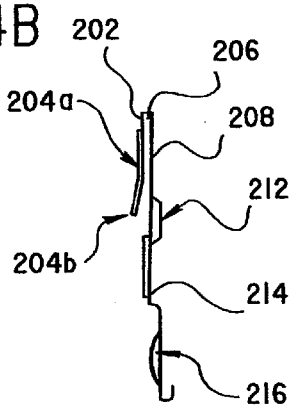
FIGS. 4A and 4B illustrate one example of a main clip.
Figure 4A:
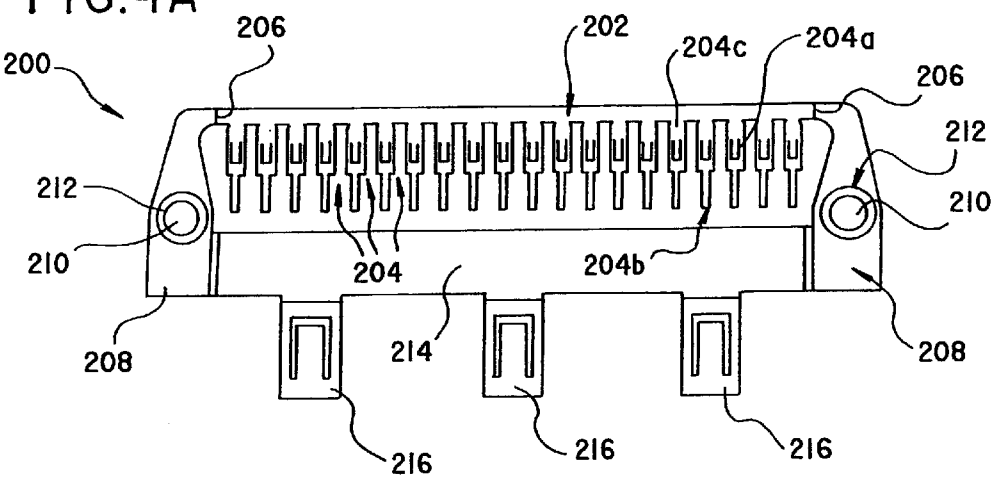

FIGS. 4A and 4B illustrate one example of main clip 200. FIG. 4A illustrates a front view of main clip 200. FIG. 4B illustrates a side view of main clip 200. Clip 200 is preferably made out of metal and formed by stamping a single sheet of metal. Clip 200 includes a carrier strip 202 from which extend a plurality of clips 204 in a direction substantially perpendicular to the length of the carrier strip 202. Each clip 204 includes a locking tang 204*a* extending from the middle of a support surface 204*c* of clip 204 and a contacting tang 204*b* extending from an end of this support surface 204*c*. Both the locking tang 204*a* and contacting tang 204*b* extend from support surface 204*c* in a direction away from the carrier strip 202 and form an angle with support surface 204*c*.

At each end of carrier strip 202, arms 206 are formed to extend in a direction perpendicular to the surface of carrier strip 202. Arms 206 connect carrier strip 202 to an exterior contact portion which includes elements 208, 214 and 216. Side portions 208 are elongated. One end of each side portion 208 is connected to a respective arm 206. At ends opposite arms 206, side portions 208 are connected to a contacting surface 214. In middles of side portions 208 are holes 210. Surrounding holes 210 are extrusions 212 extending away from the surfaces of side portions 208. Contacting surface 214 extends in the same direction as carrier strip 202 between the two side portions 208. Extending from a bottom end of contacting surface 214 are three large clips 216.

Figure 5C:
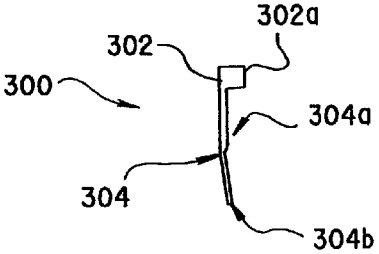
FIGS. 5A, 5B and 5C illustrate one example of a slave clip.
Figure 5B:
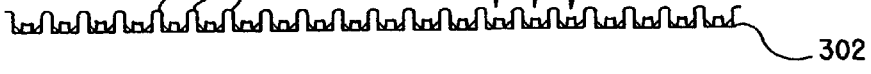
Figure 5A:
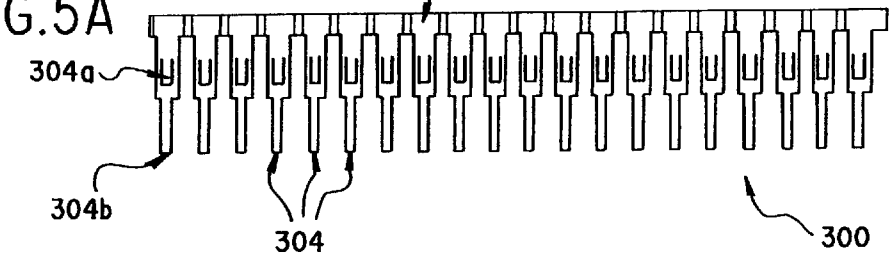

FIG. 5A illustrates a front view of slave clip 300. FIG. 5B illustrates a top view of slave clip 300. FIG. 5C illustrates a side view of slave clip 300. As shown in FIGS. 5A, 5B and 5C, slave clip 300 includes a carrier strip 302. As best shown in FIG. 5B, carrier strip 302 is bent such that it has a cross-section, in the direction in which it extends, of a plurality of adjacent "U" shapes. Ends of adjacent "U" shaped portions of carrier strip 302 are connected to form projections 302*a*. The slave clip 300 further includes a plurality of clips 304, each of which extend in a direction perpendicular to the direction in which carrier strip 302 is elongated and from a corresponding "U" shaped portion of carrier strip 302. Similar to the above described clips 204 of main clip 200, each clip 304 includes a locking tang 304*a*, a contacting tang 304*b* and a support surface 304*c*. The support surface 304*c* extends substantially perpendicular to the direction in which the carrier strip 302 is elongated. Extending from the middle of support surface 304 away from carrier strip 302 is a locking tang 304*a*. Extending from the end of support surface 304*c* in a direction away from carrier strip 302 is a contacting tang 304*b*. Both the locking tang 304*a* and contacting tang 304*b* form an angle with support surface 304*c*.

FIG. 6A illustrates a bottom view of cap 400. FIG. 6B illustrates a cross-section along the length of cap 400. FIG. 6C illustrates a cross-section along the width of cap 400. FIG. 6D is a blown-up illustration of a portion of FIG. 6C. Cap 400 may be formed of a polymer material. The exterior shape of cap 400 is designed to fit snugly within hollow 102 of main body 100. As shown, cap 400 includes a plurality of holes 410. These holes extend from the top to the bottom of cap 400, positioned side by side along the length of cap 400. The diameter of holes 410 correspond to the size of the larger diameter portion 110*a* of holes 110 of main body 100. Additionally, the location of holes 410 correspond in location to holes 110 of the main body 100 such that when cap 400 is inserted into hollow 102 of main body 100, holes 410 are axially aligned with holes 110.

On each side of the length of cap 400 are slots 408. Each slot 408 has a height which extends from the bottom of cap 400 towards the top of cap 400, but ends in a middle portion of cap 400. The lengths of slots 408 are perpendicular to the length of cap 400. When cap 400 is inserted into hollow 102 of main body 100, slots 408 will align with slots 108 of main body 100.

Extending along the length of cap 400 between slots 408 are a plurality of wedge shaped slots 402. The wedge shaped slots 402 have heights which extend from the bottom of cap 400 towards the top of cap 400, but end in a middle portion of cap 400. The wedge shaped slots 402 are aligned in a direction of their length, connecting each hole 410, as well as connecting slots 408 to the two holes at either end of cap 400. The plurality of wedge shaped slots 402 are positioned and shaped to encompass portions of carrier strip 202 of main clip 200 and carrier strip 302 of slave clip 300, as will be described further below.

Referring to FIGS. 1 and 2, the simple assembly of the grounding block is explained. Clips 204 of main clip 200 are inserted into corresponding holes 110 of main body 100. Carrier strip 202 of main clip 200, from which clips 204 extend, is positioned to rest upon carrier strip resting surface 102*a*. Arms 206 extending from carrier strip 202 are positioned within respective slots 108. Exterior contact portion (208, 214, 216) thus is positioned exterior to main body 100.

Similarly, the plurality of clips 304 of slave clip 300 are positioned in corresponding holes 110 of main body 100. Each hole 110 of main body 100 thereby houses a pair of clips (204, 304). Carrier strip 302, from which clips 304 extend, is also positioned to rest on carrier strip resting surface 102*a* (defining part of hollow 102). As can be seen best in FIG. 2, projections 302*a* of carrier strip 302 come in contact with carrier strip 202.

Cap 400 is then inserted into hollow 102 of main body 100. Cap 200 may be fixed in hollow 102 simply from friction between the walls defining hollow 102 and corresponding exterior surfaces of cap 400. Slots 408 on either end of cap 400 slide down around arms 206 of main clip 200. The plurality of wedge shape slots 402 each encompass a projection 302*a* of carrier strip 302 and a portion of carrier strip 202 adjacent to a corresponding projection 302*a*. The wedge shape of each wedge shape slot 402 acts to force carrier strip 302 into contact with carrier strip 202 at each projection 302*a*.

Additionally, metallic rivets 600 (see FIG. 1) may be utilized to more stably connect main clip 200 to main body 100. The metallic rivets 600 may be inserted through holes 210 of main clip 200 and holes 104 of main body 100. Extrusions 212 extending from the exterior of holes 210 act as springs when the rivets 600 are inserted. Further, other fastening means besides metallic rivets 600 can be used. For example, screws may be utilized in place of the metallic rivets 600. Alternatively, the exterior contact portion of main clip 200 may be designed to have clips which attach to main body 100.

As noted above, both the main clip 200 and slave clip 300 may be formed from stamping a metal sheet, thus may be easily and cheaply manufactured. The carrier strip 202 of main clip 200 can alternatively be made to also include a plurality of "U" shapes (similar to slave clip 300). However, carrier strip 202 of main clip 200 is made flat, the prestamping width of the top portion of main clip 200 (including carrier strip 202) substantially corresponds to the prestamping width of the bottom portion of main clip 200 (including contacting surface 214). If this width is not the same, folds or bumps in the bottom portion may be necessary to give the top portion and bottom portions proper widths after stamping. For example, due to arms 206, a small ridge is made on either side of contacting surface 214 to adjust the width of the bottom portion of main clip 200.

Figures 7A, 7B, 7C:
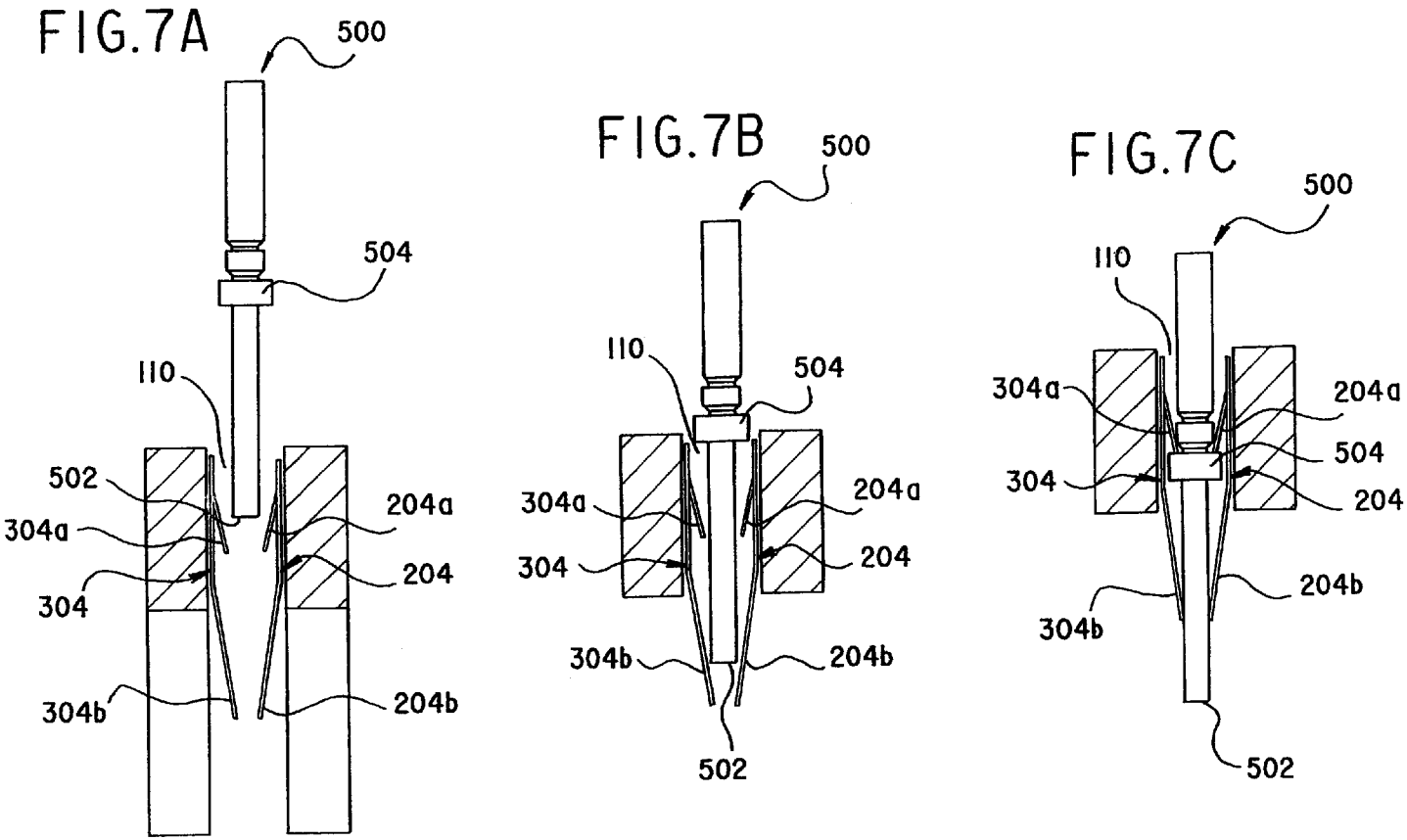
FIGS. 7A, 7B and 7C illustrate in a simplified manner how a pin 500 connects to a terminal of the grounding block.

FIGS. 7A, 7B and 7C illustrate in a simplified manner how a pin 500 connects to a terminal of the grounding block. A terminal of the grounding block is formed in each hole 110 of the main body 100. Each hole 110 of the main body 100 has positioned therein a clip 204 of main clip 200 and a clip 304 of slave clip 300. Pin 500 may be connected to a shield ground wire in a known manner (e.g., crimping or soldering).

The pin 500 is inserted into hole 110. The tip 502 of pin 500 slides past the locking tangs 204*a* and 304*a* (FIG. 7B) and the contacting tangs 204*b* and 304*b* (FIG. 7C). The angle of the locking tangs 204*a* and 304*a*, as well as the contacting tangs 204*b* and 304*b* allow the tangs to be easily pushed away from pin 500 towards the sides of the hole 110. Pin 500 is pushed into hole 110 until protrusion 504 slides past locking tangs 204*a* and 304*a*, allowing these locking tangs to snap back towards the center of the hole 110. While not shown in FIGS. 7A, 7B and 7C, the pin 500 may be prevented from further movement in this pushing direction from ledge 110*c* formed between large diameter portion 110*a* and small diameter portion 110*b* of hole 110 (see FIGS. 2 and 3C).

Contacting tangs 204*b* and 304*b* are biased to contact the end of pin 500 to establish an electrical connection. Pin 500 is prevented from being removed from hole 110 due to locking tangs 204*a* and 304*a*. After protrusion 504 of pin 500 has been pushed past locking tangs 204*a* and 304*a* in the downward direction (in FIG. 7C), movement in the upward direction is prevented, as locking tangs 204*a* and 304*a* have moved back again towards the center of hole 110 due to their natural biasing. Upon movement of pin 500 in the upward direction (in FIG. 7C), force exerted by protrusion 504 is substantially along the length of locking tangs 204*a* and 304*a* and does not cause the locking tangs to be pushed to the sides of hole 110.

After all the shield ground wires have been connected into a corresponding hole, the grounding block may be easily attached to the appropriate connector by large clips 216 of main clip 200. The contacting surface 214 establishes an electrical connection between the grounding block and this connector.

Thus, for each shield braid surrounding a signal wire, an electrical connection may be established easily from the shield braid to a shield ground wire to pin 500 to contacting tangs 204*b* and 304*b* up through each clip 204 and 304 through carrier strips 202 and 302 through arms 206 to the exterior contact portion (including side portion 208 and contacting surface 214). The contacting surface 214, contacting the appropriate portion of the connector, allows the shield braids of the shielded wires to be appropriately grounded. The continuity springs 216 allow the ground to be conducted between two mating connectors, one to which this grounding block is attached. The other grounding block may be the same as this grounding block, except that the continuity springs 216 may be omitted (because they would duplicate the function of one grounding block's continuity springs 216).

Figures 8A, 8B, 8C, 8D, 8E, 8F:
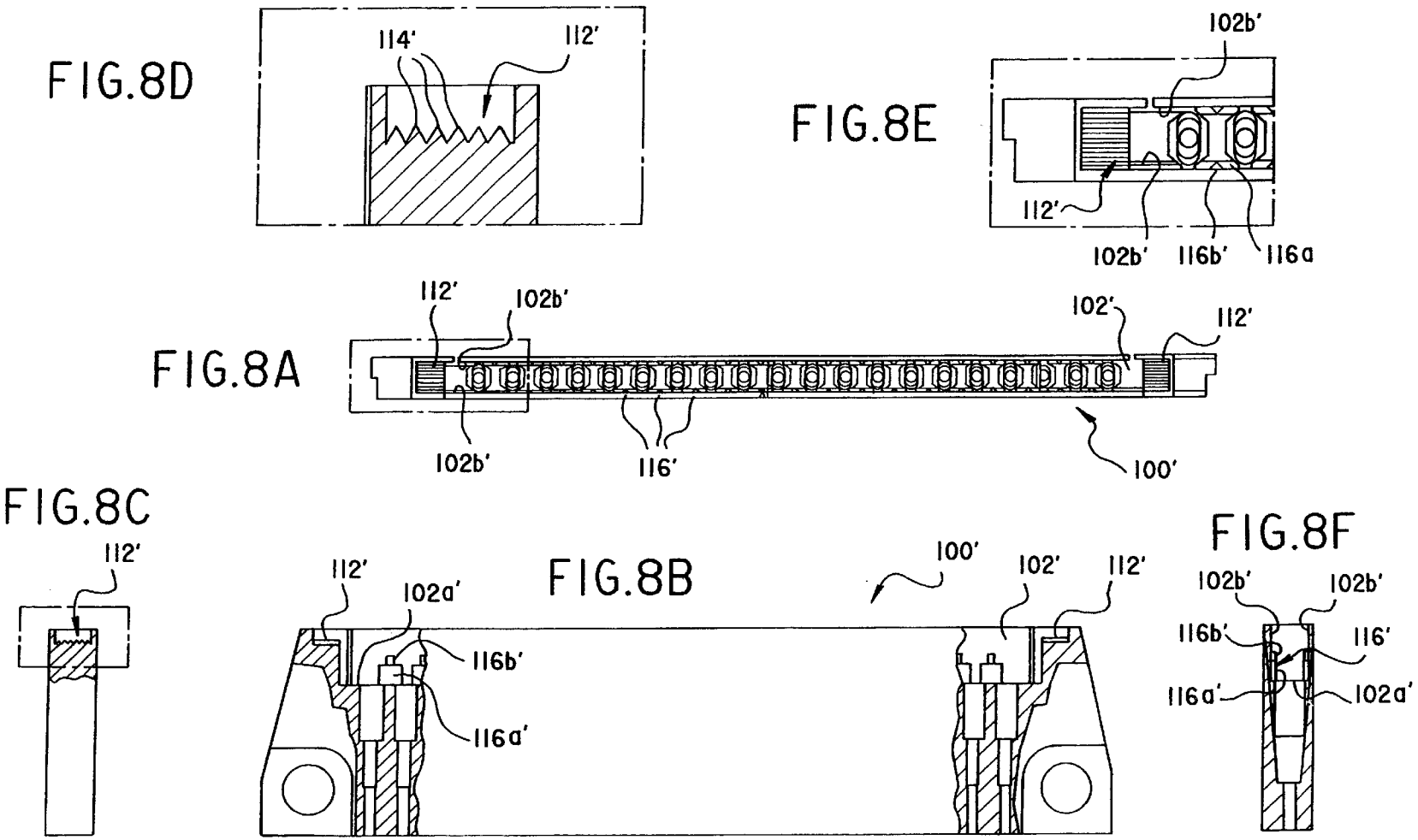
FIGS. 8A is a top view and FIG. 8B is a side view with cutaway views of another example of a main body.
FIGS. 8C and 8F illustrate cross sections of the main body illustrated in FIGS. 8A and 8B.
FIG. 8D illustrates a blown-up portion of FIG. 8C.
FIG. 8E illustrates a blown-up portion of FIG. 8A.
Figure 9C:
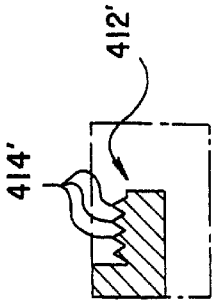
FIG. 9C illustrates a blown-up portion of FIG. 9B.
Figure 9A:
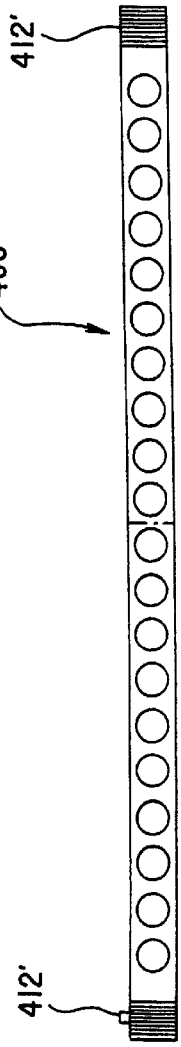
FIG. 9A illustrates a top view of another example of a cap.
Figure 9B:
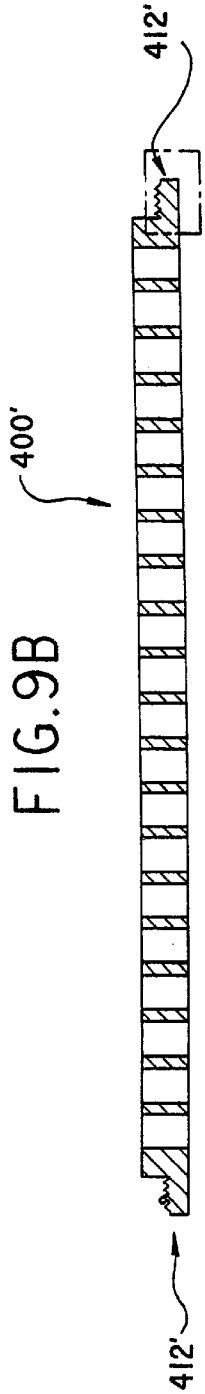
FIG. 9B illustrates a cross section of the cap of FIG. 9A.

FIGS. 8A–8F illustrate details of another example of a main body, FIGS. 9A–9C illustrate details of another example of a cap. Instead of or in addition to connecting the cap to the main body via a friction fit, the cap and the main body may be connected by ultrasonically welding. FIG. 8A is a top view and FIG. 8B is a side view with cutaway views of another example of the main body 100'. Main body 100' has two shelf portions 112' formed on either end of hollow 102'. The shelf portions 112' form an intermediate step between the carrier strip resting surface 102*a*′ and the exterior of the main body 100'. FIG. 8C illustrates a cross section of main body 100' at one of the shelf portions 112' and FIG. 8D illustrates a blown-up portion of FIG. 8C. FIG. 8E illustrates a blown-up portion of FIG. 8A. As best shown in FIGS. 8C, 8D and 8E, each shelf portion 112' has a plurality of ridges 114' formed thereon. In this example, the ridges 114' run parallel to the length of the main body 100'.

Hollow 102' is partially defined by two opposing surfaces 102*b*′ which extend along the length of the main body 100' and are perpendicular to the carrier strip resting surface 102*a*′. On each of the two opposing surfaces 102*b*′ a plurality of tower-like projections 116' are formed. Each of the projections 116' extend perpendicular to the carrier strip resting surface 102*a*′ and project away form a corresponding surface 102*b*′ on which the projections 116' is formed. Each projection 116' includes a base part 116*a*′ having a extending from the carrier strip resting surface 102*a*′ . The upper surfaces of the wide base part 116*a*′ are substantially flat and at the same level. Each projection 116' also has a ridge part and a smaller ridge part 116*b*′ extending from the upper surface to its base part 116*b*′ . The ridge part is smaller than the base part 116'.

FIG. 9A illustrates a top view of another example of a cap 400'. FIG. 9B illustrates a cross section of cap 400'. FIG. 9C illustrates a blown-up portion of an end of cap 400'. As illustrated in FIGS. 9A, 9B and 9C, cap 400' includes shoulder portions 412' on either end of the cap. On each shoulder portion, a plurality of ridges 414' are formed. In this example, the ridges 414' are perpendicular to the length of cap 400'

A main clip and slave clip may be inserted into main body 100' as described above in connection with the first example. When cap 400' is inserted into hollow 102' of main body 100', the cap will come to rest upon base portions 116*a'*. Unlike cap 400, cap 400' does not have any wedge portions (or other cavities) to accept portions of the slave clip and the main clip. Thus, base portions 116*a'* of the main body 100' prevent the cap 400' from being inserted too far into the hollow 102' and thus prevent possible damage to the main clip and the slave clip.

In addition or alternative to any friction fit between the main body 100' and the cap 400', the main body 100' and the cap 400' are connected via an ultrasonic welding. More specifically, the main body 100' and the cap 400' are subjected to ultrasonic radiation which melts ridges 114' and ridge parts 116*b'* of main body 100' and ridges 414' of cap 400'. The melted portions of the main body 100' and cap 400' solidify to connect the main body 100' and the cap 400'. Remaining portions of the main body 100' and the cap 400' are thick enough so that they are not melted or undesirably deformed by the ultrasonic radiation.

Figures 10A, 10B, 10C, 10D:
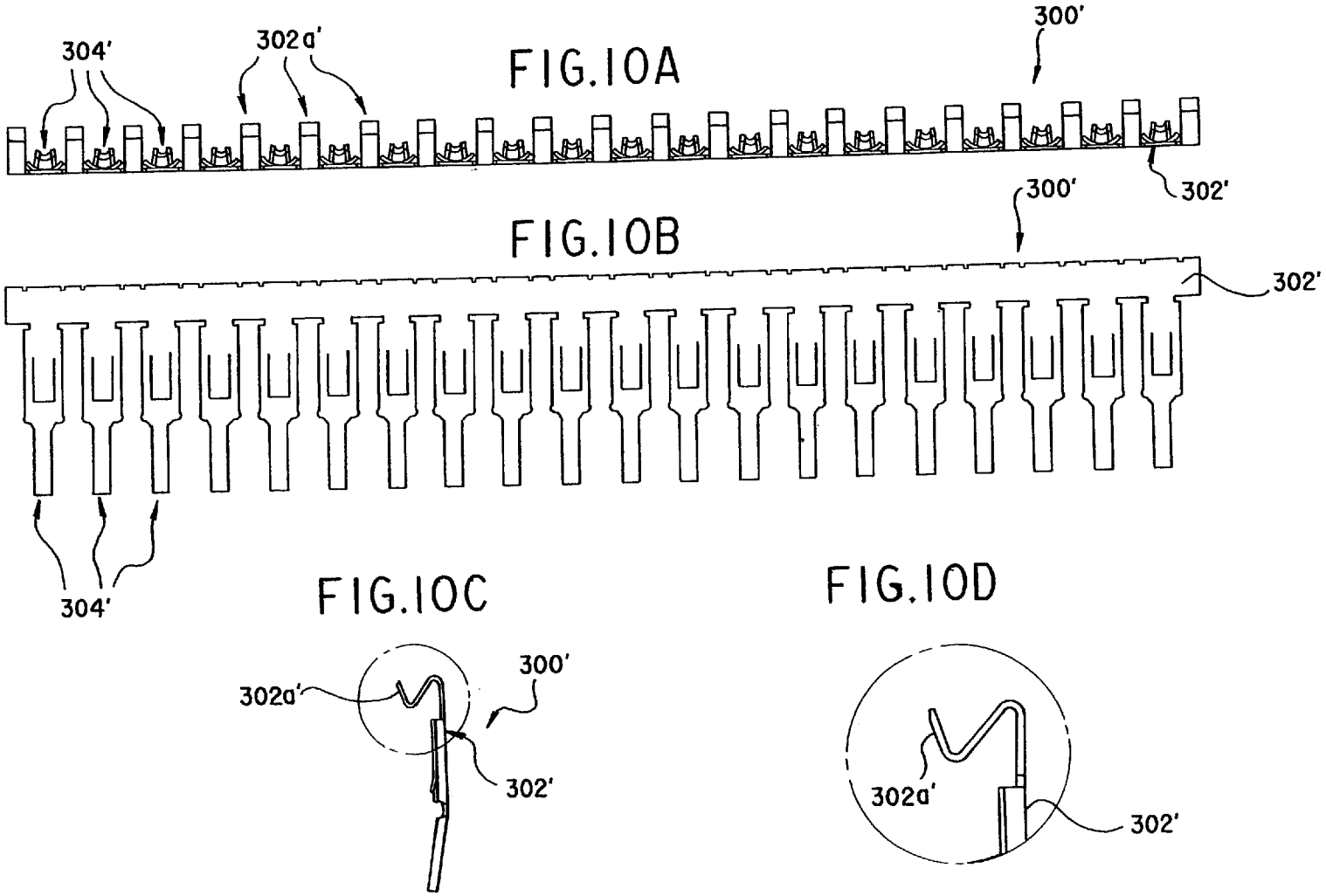
FIG. 10A is a top view.
FIG. 10B is a front view and FIG. 10C is a side view of another example of a slave clip.
FIG. 10D is a blown-up view of a portion of FIG. 10C.

FIGS. 10A, 10B, 10C and 10D illustrate details of an another example of a slave clip. FIG. 10A is a top view of slave clip 300'. FIG. 10B is a front view of slave clip 300'. FIG. 10C is a side view of slave clip 300'. FIG. 10D is a blown-up view of a portion of FIG. 10C. Slave clip 300' illustrated in FIGS. 10A, 10B, 10C and 10D is similar to slave clip 300 illustrated in FIGS. 5A, 5B and 5C except that the "U"-shaped projections 302*a* have been replaced by "Z" or "S" shaped projections 302*a'*. The projections 302*a'* extend from a top portion of carrier strip 302' (opposite from clips 304') and between each clip 304'. The projections 302*a'* are "Z" or "S" shaped in cross sections take in a direction which is perpendicular to carrier strip 302' and perpendicular to the length of carrier strip 302'.

The assembly of the grounding block using slave clip 300' is the same as in the above examples. However, contact between the main clip and the slave clip 300' is made by projections the "S" or "Z" shaped projections 302*a'* rather than the "U" shaped projections 302 (in FIG. 5). Projections 302*a'* may have a spring-like structure so that the projections 302*a'* can be made longer than is absolutely necessary to assure contact with the main clip while allowing the length of projections 302*a'* to be made smaller if necessary when fitted in the hollow of the main body. Thus, lower tolerances for the associated dimensions of the slave clip are acceptable. It is emphasized that the "S" and "Z" shape of the projections 302*a'* are merely exemplary and many additional shapes will be apparent to those skilled in the art. Also, although preferred, it is emphasized that these projections 302*a'* do not require a spring-like structure.

Because projections 302*a'* extend from the top of carrier strip 302' (and are not formed by bending carrier strip 302'), the length of the carrier strip 302' is set after punching or cutting carrier strip 302' from a piece of metal, thus more easily attaining accurate dimensions of slave clip 300'.

Figure 11B:
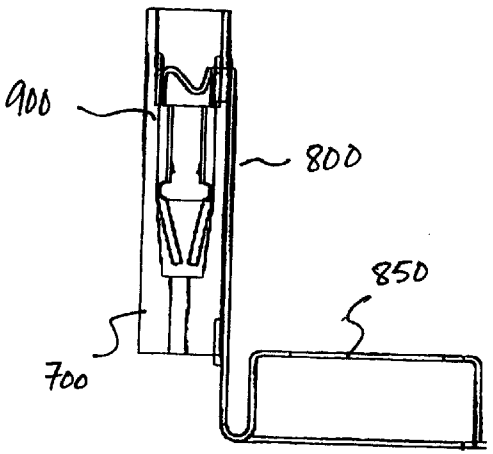
FIGS. 11A and 11B illustrate cut-away side views of another example of a grounding block.
Figure 11A:
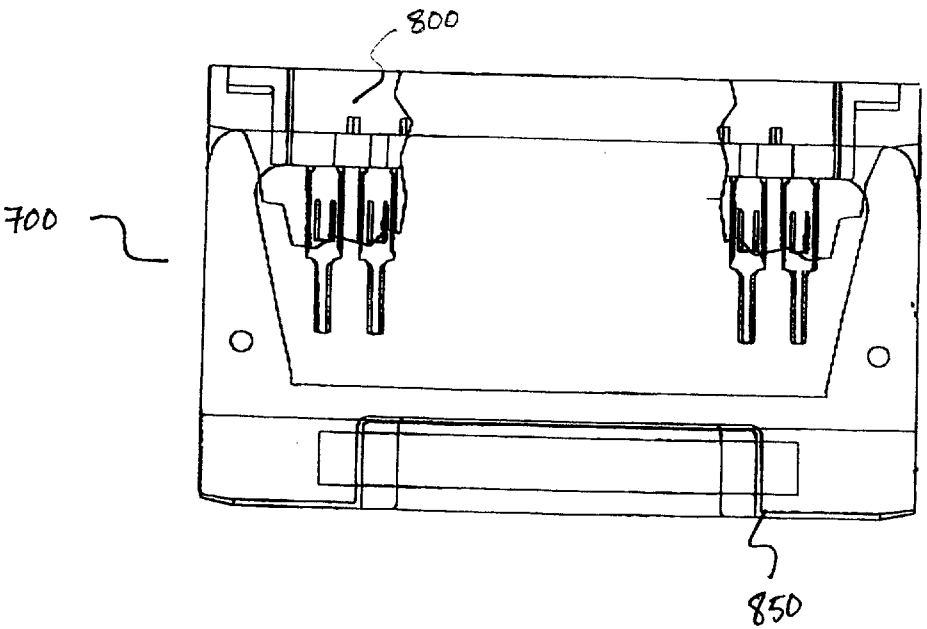

FIGS. 11A and 11B illustrate views of another example of a grounding block. FIG. 11A illustrates a cut-away side view of a polymeric main body 700 with a main clip 800 and a slave clip 900 mated together.

The main body 700 may be similar in form, function and construction to the main body 100 or 100'. The lower portion of the main body 700, however, may accommodate a protruding portion 850 of the main clip 800. In the embodiment shown, protruding portion 850 protrudes horizontally from main clip 800. In other embodiments, the protruding portion 850 may protrude vertically or a combination of vertically and horizontally. The protruding portion 850 forms a mating portion for interfacing with a connector (not shown), for example a D-Subminiature connector. Details of connectors and D-Subminiature connectors are well known in the art and are, therefore, not discussed. In the embodiment shown, the protruding portion 850 projects at approximately 90° from the main clip 800. In other embodiments, other angles may be used to position the main body in a desired position relative to the connector.

FIG. 11B illustrates a cross-sectional side view of the main body 700 and a main clip/slave clip intersection. The upper portion of the main clip 800 is similar in form, function and construction to the main clip 200 or 200'. The slave clip 900 is similar in form, function and construction to the slave clip 300 or 300'. However, the lower portion of the main clip 800 differs from main clips 200 and 200' in that a connector mating portion 850, is accommodated. In the embodiment shown, the mating portion 850 is configured to mate with a D-Subminiature connector. The mating portion, however, may be configured to mate with any desired connector. Consequently, the same potential block is configured to form a low-profile back shell to mate to a D-Subminiature connector or other connector (not shown).

The connector mating portion 850 may be integrally formed on the lower end of the main clip 800 and may accommodate connections to any one of several orientations as desired. In the embodiment shown, connection may be facilitated from a "top" orientation. One of ordinary skill may modify the embodiment to facilitate a "bottom" orientation, if desired.

The main clip 800 and slave clip 900 are preferably made of metal and formed by stamping a single sheet of metal. Alternative methods, as is well known in the art, may be used for manufacturing the main clip 800 and slave clip 900. For example, the mating portion 850 may be formed in the same process for forming the main clip 800 and/or by integrally attaching a mating portion 850 to the main clip 800 by any one of numerous means known to one of ordinary skill in the art.

Figure 12C:
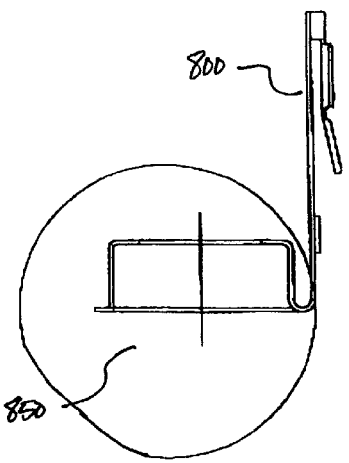
FIGS. 12A, 12B, and 12C illustrate a front, top, and side view, respectively, of another example of a main clip.
Figure 12A:
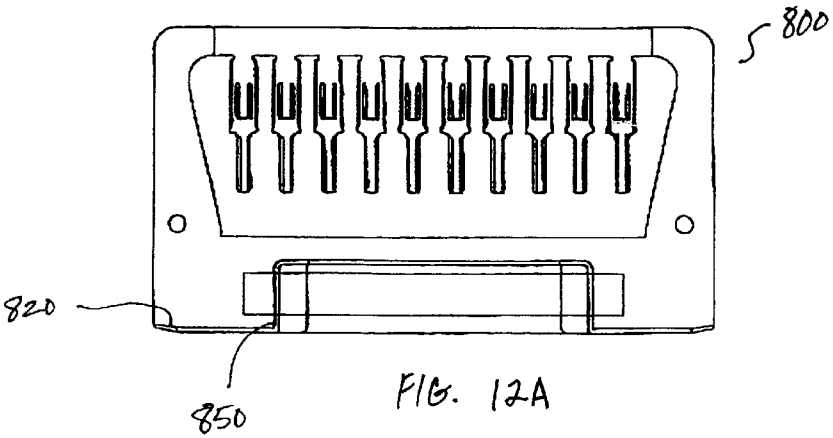
Figure 12B:
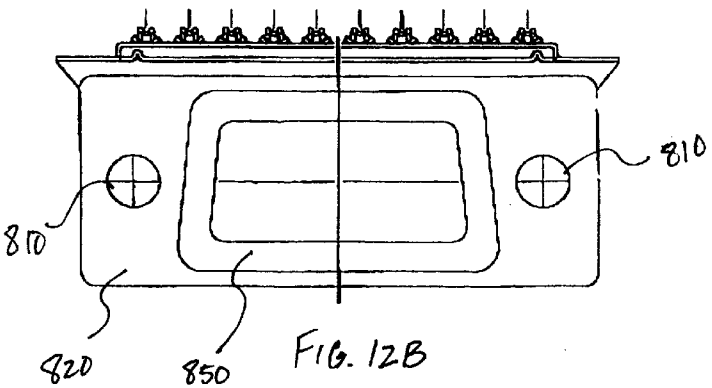

FIGS. 12A–C illustrate a front, top and side view of the main clip 800, respectively. FIGS. 12B and 12C illustrate the 90-degree angle formed by the mating portion 850. Other angles may be employed in other embodiments to meet the user's needs. FIG. 12B illustrates holes 810 which may be oppositely located on the lower flange protruding sides 820 of the mating portion 850 of main clip 800. These holes 810 are located to allow fasteners associated with the connector to pass through. The actual location of holes 810 will depend on the connector. Some embodiments may not have holes 810. In other embodiments, other devices for affixing a connector to the mating portion 850 may be utilized. For example, sliding clips or pressure contacts may be used to attach a connector to the mating portion 850.

Figure 13:
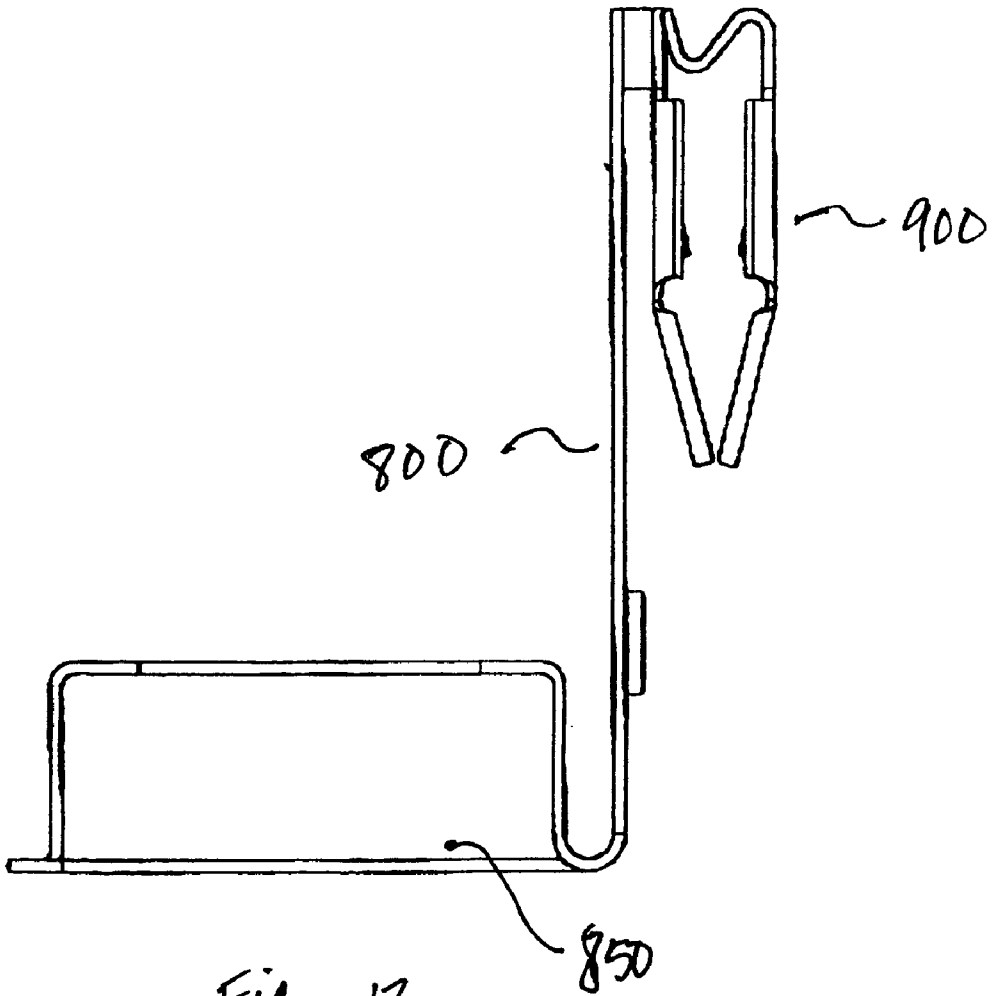
FIG. 13 illustrates a side view of the main clip of FIGS. 12A–C and a slave clip mated together.

FIG. 13 illustrates a side view of a main clip 800 mated to a slave clip 900. With the exception of the connector mating portion 850, the main clip 800 and slave clip 900 are similar to main clip 800 and slave clip 900 discussed above.

It is emphasized that the above-detailed examples are set forth merely to describe the best mode of how to make and use the invention to one of ordinary skill in the art. The description is intended only to be exemplary and not limiting. For example, though the slave clip, in FIGS. 11 and 13 are illustrated as having a S- or Z-shape, it is readily apparent that alternate slave clip, such as shown in FIG. 5, for example, may be used. Accordingly, other types of contacting structure will be apparent to those of ordinary skill in the art, for example, a contacting structure that does not necessitate use of slave clip or a contacting structure which uses additional elements. Similarly, the main clip and slave clip can be easily modified to accommodate different types of pins or other contacting structures. It is again emphasized that this block may be used to connect several wires to the same potential, other than a grounding potential. The term "grounding block" as used in this specification means blocks for connecting several wires to the same potential, whether this potential is a ground potential or not.

Additionally, while the invention refers to a D-Subminiature connector, it is well within the knowledge of one of ordinary skill in the art to adapt the invention to utilize variations of the D-Subminiature connector or other connectors that require a grounding block or same potential block.

Therefore, other modifications of the invention will be apparent to those of ordinary skill in the art. The scope and spirit of the invention is intended to be defined only by the following claims.

We claim:

1. A same potential block comprising:

a main body having a plurality of holes formed therein;

a first metal piece, including a first carrier strip located adjacent to said main body and a plurality of first clips extending from said first carrier strip, each of said plurality of first clips positioned within a corresponding hole of said plurality of holes formed in said main body;

an exterior contact portion protruding from the main body and connected to said first metal piece to form a connector mating structure; and a plurality of pins inserted into said plurality of holes, each of said pins having a protrusion for connecting with said connector mating structure, wherein said carrier strip maintains the same potential across each of said plurality of clips and a connector ground connected to the exterior contact portion and said plurality of first clips are adapted to receive terminal portions of wires to thereby keep the wires at the same potential.

2. The same potential block of claim 1, wherein the contact portion forms a mating structure for a D-Subminiature connector.

3. The same potential block of claim 1, wherein said carrier strip includes a contacting surface adapted to contact a first connector and said exterior contact portion forms a rear mating structure for a D-Subminiature connector.

4. The same potential block of claim 1, wherein said exterior contact portion includes two side portions extending in a direction substantially perpendicular to a direction in which said first carrier strip extends and said same potential block further comprises, at each of said two side portions of said external contact portion, means for connecting said exterior contact portion to said main body.

5. The same potential block of claim 1, wherein said exterior contact portion includes two side portions extending in a direction substantially perpendicular to a direction in which said first carrier strip extends, and said same potential block further comprises an eyelet for connecting the two side portions of said exterior contact portion to said main body.

6. The same potential block of claim 1, wherein the same potential block is a grounding block, and said carrier strip maintains a ground potential across each of said plurality of clips.

7. The same potential block of claim 1, wherein the same potential block is a bussing block for carrying a constant positive or negative potential.

8. The same potential block of claim 1, wherein the same potential block is a bussing block for carrying signals.

9. A same potential block comprising:

a main body having a plurality of holes formed therein;

a first metal piece, including a first carrier strip located adjacent to said main body and a plurality of first clips extending from said first carrier strip, each of said plurality of first clips positioned within a corresponding hole of said plurality of holes formed in said main body; and an exterior contact portion protruding from the main body and connected to said first metal piece to form a connector mating structure, wherein said carrier strip maintains the same potential across each of said plurality of clips and a connector around connected to the exterior contact portion and said plurality of first clips are adapted to receive terminal portions of wires to thereby keep the wires at the same potential, wherein said main body has an elongated hollow formed on an elongated side in which said first carrier strip is positioned and has a slot formed on each end of said elongated hollow; and said exterior contact portion is joined to ends of said first carrier strip through the slots formed in said main body.

10. A same potential block comprising:

a main body having a plurality of holes formed therein;

a first metal piece, including a first carrier strip located adjacent to said main body and a plurality of first clips extending from said first carrier strip, each of said plurality of first clips positioned within a corresponding hole of said plurality of holes formed in said main body; and an exterior contact portion protruding from the main body and connected to said first metal piece to form a connector mating structure, wherein said carrier strip maintains the same potential across each of said plurality of clips and a connector ground connected to the exterior contact portion and said plurality of first clips are adapted to receive terminal portions of wires to thereby keep the wires at the same potential, wherein said main body is made of a polymer material.

11. A same potential block comprising:

a main body having a plurality of holes formed therein;

a first metal piece, including a first carrier strip located adjacent to said main body and a plurality of first clips extending from said first carrier strip, each of said plurality of first clips positioned within a corresponding hole of said plurality of holes formed in said main body; and an exterior contact portion protruding from the main body and connected to said first metal piece to form a connector mating structure, wherein said carrier strip maintains the same potential across each of said plurality of clips and a connector ground connected to the exterior contact portion and said plurality of first clips are adapted to receive terminal portions of wires to thereby keep the wires at the same potential, further comprising:

a second metal piece, including a second carrier strip located adjacent to said main body, a plurality of second clips extending from said second carrier strip, each positioned with a corresponding hole of said plurality of holes formed in said main body to mate with a corresponding one of said plurality of first clips thereby forming a pair of a first clip and a second clip within each hole formed in said main body.

12. The same potential block of claim 11, wherein within each of said plurality of holes formed in said main body, said pair of a first clip and a second clip form a female connector portion for receiving a terminal pin connected to a wire.

13. The same potential block of claim 11, wherein said plurality of holes formed in said main body are elongated in a first direction, and each clip of said plurality of first clips and said plurality of second clips is elongated in said first direction and includes a locking tang extending towards the center of the corresponding hole from an intermediate portion of the clip and a contacting tang extending towards the center of the corresponding hole, each clip extending form said carrier strip and terminating with said contacting tang, wherein in each of said plurality of holes formed in said main body, locking tangs of a pair of a first clip and a second clip are flexible to allow insertion of a terminal pin of a wire and have end portions to engage a projection of the terminal pin of the wire to interrupt removal of the terminal pin of the wire, wherein, in each of said plurality of holes formed in said main body, contacting tangs extend to contact a conducting portion of the terminal pin of the wire.

14. The same potential block of claim 11, wherein each clip of said plurality of first clips and said plurality of second clips is elongated in a direction perpendicular to said first carrier strip and has an arcuate cross section in a direction parallel to the first carrier strip.

15. The same potential block of claim 11, wherein said first carrier strip is flat; and said second carrier strip has a cross section in a direction in which said second carrier strip extends including a plurality of adjacent "U" shapes.

16. The same potential block of claim 11, wherein said main body includes a hollow having a first surface, each of said plurality of holes formed in said main body includes a first cylindrically formed hole having a first diameter and a second cylindrically formed hole having a second diameter, said first cylindrically formed hole extending from said first surface of said hollow to said second cylindrically formed hole, said first and second cylindrically formed holes being coaxial, and said first diameter being larger than said second diameter.

17. The same potential block of claim 11, wherein said first carrier strip is flat; and said second carrier strip has a plurality of projections extending from a side from which said plurality of clips extend from said second carrier strip, wherein said plurality of projections contact said first carrier strip.

18. The same potential block of claim 17, wherein said plurality of projections extending from said second carrier strip are springs.

19. The same potential block of claim 18, wherein said plurality of projections extending from said second carrier strip have an "S" or "Z" shape.

20. The same potential block of claim 11, further comprising:

a cap having a plurality of holes formed therein, connected to said main body such that the plurality of holes of said cap align with the plurality of holes of said main body.

21. The same potential block of claim 20, wherein said main body and said cap are made of a polymer material.

22. The same potential block of claim 20, wherein said main body includes a hollow portion having a first surface at which said plurality of holes formed within said main body terminate and said cap is positioned within said main body.

23. The same potential block of claim 22, wherein said cap and said main body are affixed to one another.

24. The same potential block of claim 23, wherein the cap and main body are glued together.

25. The same potential block of claim 23, wherein said cap and said main body are ultrasonically welded together.

26. The same potential block of claim 23, wherein said hollow portion of said main body includes projections along surfaces extending from said first surface, and said cap rests upon upper surfaces of said projections.

27. The same potential block of claim 22, wherein said cap abuts said first surface of said hollow portion and is frictionally engaged with said hollow portion of said main body.

28. The same potential block of claim 27, wherein said first carrier strip of said first metal piece and said second carrier strip of said second metal piece are positioned between said first surface of said hollow portion of said main body and said cap.

29. The same potential block of claim 28, wherein said cap includes a wedge shaped slot wherein portions of said first and second carrier strips are positioned within the slot, wherein when said cap is pushed into the hollow of said main body, said portions of said first and second carrier strips located within said wedge shaped slot are forced together.

30. A potential block comprising:

receiving means for receiving terminal portions of wires;

a main body means for housing the receiving means;

external contact means protruding from the main body means to form a connector mating structure for mating with a connector; and a metal busing means for connecting the receiving means and the external contact means, wherein said terminal portions include a plurality of pins each having a protrusion extended therefrom for connection thereof to said connector mating structure; and the metal busing means maintains the same potential across the terminal portions of the wires and the connector connected to the external contact means.

* * * * *